US005118146A

United States Patent [19]

Watanuki

[11] Patent Number: 5,118,146

[45] Date of Patent: Jun. 2, 1992

[54] LOCK DEVICE FOR HOOD OF AUTOMOTIVE ENGINE ROOM HAVING A LOST-MOTION MECHANISM

[75] Inventor: Yoshio Watanuki, Kanagawa, Japan

[73] Assignee: Nissan Motor Co., Ltd., Yokohama, Japan

[21] Appl. No.: 717,254

[22] Filed: Jun. 18, 1991

[30] Foreign Application Priority Data

Jul. 19, 1990 [JP] Japan ..... 2-189317

[51] Int. Cl.[5] ..... E05C 3/26

[52] U.S. Cl. ..... 292/216; 292/DIG. 43; 292/341.16; 292/DIG. 62

[58] Field of Search ..... 292/216, DIG. 14, DIG. 23, 292/DIG. 43, DIG. 62, DIG. 25, 341.16

[56] References Cited

U.S. PATENT DOCUMENTS

| | | | |
|---|---|---|---|
| 3,905,624 | 9/1975 | Fujita | 292/DIG. 14 |
| 3,985,381 | 10/1976 | Kobayashi | 292/DIG. 43 |
| 4,334,704 | 6/1982 | Yamada | 292/216 |
| 4,452,058 | 6/1984 | Noel | 292/216 |
| 4,478,441 | 10/1984 | Fiordellisi et al. | 292/DIG. 25 |
| 4,634,156 | 1/1987 | Shimura et al. | 292/216 |
| 4,756,563 | 7/1988 | Garwood et al. | 292/216 |
| 4,906,035 | 3/1990 | Nagai et al. | 292/DIG. 43 |
| 4,917,420 | 4/1990 | Rogers, Jr. | 292/DIG. 14 |
| 4,974,885 | 12/1990 | Yokohama | 292/DIG. 43 |

FOREIGN PATENT DOCUMENTS

| | | | |
|---|---|---|---|
| 1553470 | 8/1970 | Fed. Rep. of Germany | 292/216 |
| 8925 | 1/1978 | Japan | 292/216 |
| 35918 | 3/1979 | Japan | 292/216 |
| 62-42107 | 9/1987 | Japan . | |
| 1114924 | 5/1968 | United Kingdom | 292/216 |
| 2056542 | 3/1981 | United Kingdom | 292/216 |

*Primary Examiner*—Eric K. Nicholson
*Attorney, Agent, or Firm*—Foley & Lardner

[57] ABSTRACT

The lock device for locking a striker pin is shown, which comprises a base plate to which a latch plate is pivotally connected. The latch plate is formed with a latching notch. The latch plate can assume a full-latch position wherein the latching notch fully latches the striker pin, a half-latch position wherein the latching notch incompletely latches the striker pin and a release position wherein the latching notch fully releases the striker pin. A first spring is used for biasing the latch plate to pivot toward the release position. A locking plate is pivotally connected to the base plate and has a pawl portion which is engageable with the latch plate to provide the latch plate with the full-latch and half-latch positions. A second spring is used for biasing the locking plate to pivot in a direction to achieve the engagement between the pawl portion and the latch plate. A full open lever is pivotally connected to the base plate. A lost-motion mechanism is arranged between the locking plate and the full open lever so that when, with the latch plate assuming the half-latch position, the full open lever is pivoted beyond a given degree, the pawl portion of the locking plate is disengaged from the latch plate thereby to permit the latch plate to assume the release position.

10 Claims, 4 Drawing Sheets

LOCK DEVICE FOR HOOD OF AUTOMOTIVE ENGINE ROOM HAVING A LOST-MOTION MECHANISM

BACKGROUND OF THE INVENTION

1. Field of the Invention

The present invention relates to lock devices for a hood of an automotive engine room, and more particularly to lock devices of a type which locks a front portion of a rear-hinged hood of the engine room to a vehicle body. More specifically, the present invention is concerned with lock devices of a type which can permit the hood to have half-latched and full-latched positions relative to the vehicle body.

2. Description of the Prior Art

In order to clarify the task of the present invention, one conventional lock device of the above-mentioned type will be described with reference to FIG. 8 of the accompanying drawings, which is disclosed in Japanese Patent Second Provisional Publication No. 62-42107. The drawing is a view taken from the front of a vehicle body.

In the drawing, denoted by numeral 1 is a base plate which is secured to a front rigid portion of an engine room. The base plate 1 is formed at its upper middle portion with a vertically extending slot 4. The slot 4 can receive therein a striker pin 3 which is secured to a front portion of a hood 2 of the engine room. The hood 2 has a rear end hinged to the vehicle body, so that the hood 2 can open forward. Denoted by numeral 5 is a latch plate, 6 is a locking plate and 7 is a full open lever which are all pivotally connected to the base plate 1 in the illustrated manner.

When the hood 2 is kept fully opened, the latch plate 5 is forced to assume a releasing position having its latching notch directed upward due to biasing force of a spring (not shown) arranged between the base plate 1 and the latch plate 5.

When, for closing the hood 2, the same is pivoted down in the direction of the arrow D in the drawing, the striker pin 3 slides down in the slot 4 and engages with the latching notch of the latch plate 5 pushing the latch plate 5 to rotate in the direction of the arrow A against the biasing force of the spring. When, due to further downward movement of the striker pin 3, the latch plate 5 rotates and comes to a given angular position, a projection 5*a* of the latch plate 5 rides over a projection 6*a* of the locking plate 6 and comes into engagement with the back of the projection 6*a*, as is shown by a broken line in the drawing. Because the locking plate 6 is biased by a spring in a direction opposite to the direction of the arrow C, the engagement of the projection 5*a* with the back of the projection 6*a* suppresses a rotation of the latch plate 5 in the opposite direction, that is, in the direction of the arrow B. Thus, the striker pin 3 is fully latched by the latch plate 5 inducing a fully latched condition of the hood 5. Under this condition, the hood 2 assumes the closed position as illustrated by a solid line.

When, for opening the hood 2, a hood open lever (not shown) arranged, for example, beside a driver's seat is manipulated, a cable 8 fixed to the locking plate 6 is pulled. With this, the locking plate 6 is pivoted in the direction of the arrow C against the spring cancelling the engagement of the latch plate 5 with the locking plate 6. Thus, upon this, the latch plate 5 is rotated in the direction of the arrow B due to the biasing force of the spring releasing the striker pin 3. Thus, the hood 2 is lifted due to a biasing force of a lift mechanism (not shown).

When the hood 2 is lifted to a given position as shown by a phantom line in FIG. 8, a pawl member 9 secured to the hood 2 is brought into latching engagement with a hook portion 10 of the full open lever 7 to provide a halfly latched condition of the hood 2. Under this condition, there is defined between the front end of the hood 2 and the front rigid portion of the engine room a certain clearance which is sized to permit insertion of an operator's hand.

When the full open lever 7 is manipulated to pivot in the direction of the arrow E by the operator's hand, the engagement of the pawl member 9 with the full open lever 7 becomes cancelled. Thus, thereafter, the hood 2 is permitted to open freely with an aid of the lift mechanism.

However, the above-mentioned hood lock device has the following drawbacks due to its inherent construction.

First, since the hook portion 10 of the full open lever 7 is largely projected upward beyond the base plate 1, the hood 2 fails to assume a sufficiently low position. This is disadvantageous in designing the vehicle body.

Second, due to provision of the pawl member 9, manipulation of the full open lever 7 through the small clearance between the halfly latched hood 2 and the engine room is difficult. Furthermore, due to usage of the pawl member 9, the number of parts used is increased.

SUMMARY OF THE INVENTION

It is therefore an object of the present invention to provide a hood lock device which is free of the above-mentioned drawbacks.

According to the present invention, there is provided a hood lock device in which both the fully latched and halfly latched conditions of the hood are obtained by only the latch plate and the striker pin.

According to the present invention, there is provided a lock device for locking a striker pin. The lock device comprises a base plate; a latch plate pivotally connected to the base plate, the latch plate being formed with a latching notch, the latch plate having a full-latch position wherein the latching notch fully latches the striker pin, a half-latch position wherein the latching notch incompletely latches the striker pin and a release position wherein the latching notch fully releases the striker pin; first biasing means for biasing the latch plate to pivot toward the release position; a locking plate pivotally connected to the base plate, the locking plate having a pawl portion which is engageable with the latch plate to provide the latch plate with the full-latch and half-latch positions; second biasing means for biasing the locking plate to pivot in a direction to achieve the engagement between the pawl portion and the latch plate; a full open lever pivotally connected to the base plate; and a lost-motion mechanism arranged between the locking plate and the full open lever so that when, with the latch plate assuming the half-latch position, the full open lever is pivoted beyond a given degree, the pawl portion of the locking plate is disengaged from the latch plate thereby to permit the latch plate to assume the release position.

BRIEF DESCRIPTION OF THE DRAWINGS

Other objects and advantages of the present invention will become apparent from the following description when taken in conjunction with the accompanying drawings in which.

DETAILED DESCRIPTION OF THE INVENTION

Figure 1:
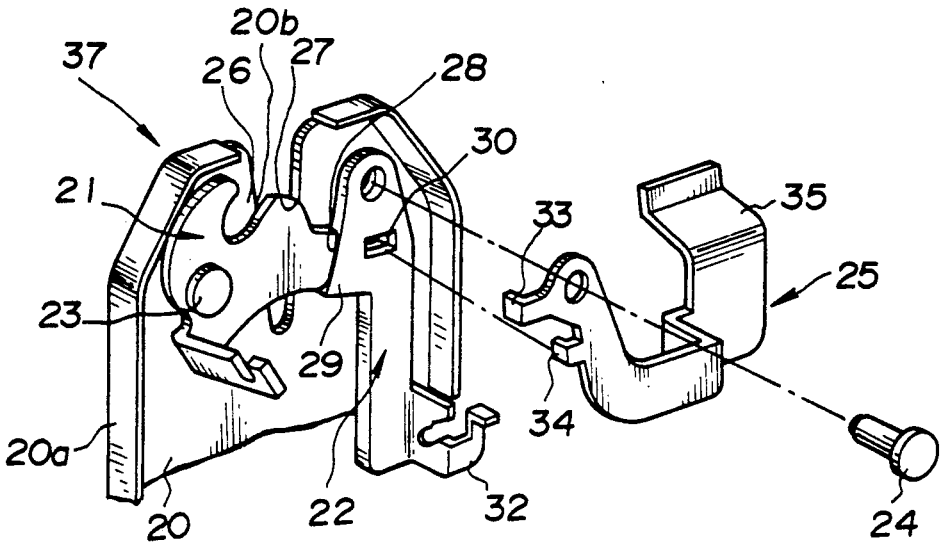
FIG. 1 is a perspective view of a hood lock device of the present invention with some parts disassembled.
Figure 2:
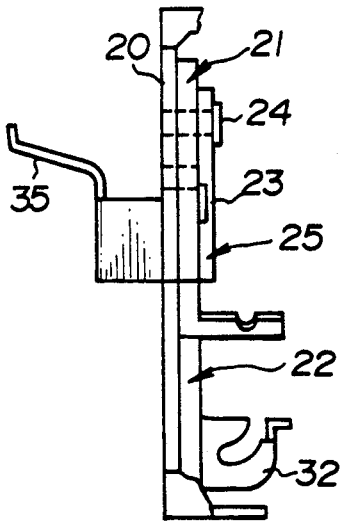
FIG. 2 is a side view of the hood lock device of the invention in an assembled condition.

Referring to FIGS. 1 to 7, particularly FIG. 1, there is shown a hood lock device 37 according to the present invention.

As is best seen from FIG. 1, the hood lock device 37 comprises a base plate 20 which is secured to a front rigid portion of an engine room. The base plate 20 has around its periphery a low side wall 20*a* thereby to define a shallow recess within the side wall 20*a*. Upon assembly of the base plate 20 on the engine room, the shallow recess faces the engine room.

The base plate 20 is formed at its upper middle portion with a vertically extending slot 20*b* for receiving a striker pin 3 (see FIG. 3) secured to a front lower portion of a hood for the engine room.

Within the recess of the base plate 20, there are installed a latch plate 21 and a locking plate 22 which are pivotally connected to the base plate 20 through respective pivot pins 23 and 24.

Pivotally movably arranged on the locking plate 22 is a full open lever 25 which is pivotally connected to the pivot pin 24.

The latch plate 21 is formed with a latching notch 26 which is sized to receive the striker pin 3. As is seen from FIG. 3, a spring 36 is arranged between the latch plate 21 and the base plate 20 to bias the latch plate 21 in the direction of the arrow G.

The latch plate 21 is further formed with a first engaging portion 27 and a second engaging portion 28. As will become apparent as the description proceeds, these first and second engaging portions 27 and 28 are brought into engagement with the locking plate 22 when the full-latch and half-latch conditions of the hood lock device take plate.

It is to be noted that the distance between the second engaging portion 28 and the center of the pivot pin 23 is greater than that between the first engaging portion 27 and the center of the pivot pin 23.

The locking plate 22 is formed with a pawl portion 29 which is engageable with the first and second engaging portions 27 and 28 of the latch plate 21. The locking plate 22 has further a curved slot 30 which is concentric with the pivot pin 24. The locking plate 22 has an outwardly projected lower portion 32 to which a cable 31 (see FIG. 3) from a hood open lever (not shown), which is arranged for example beside a driver's seat, is connected.

Figure 3:
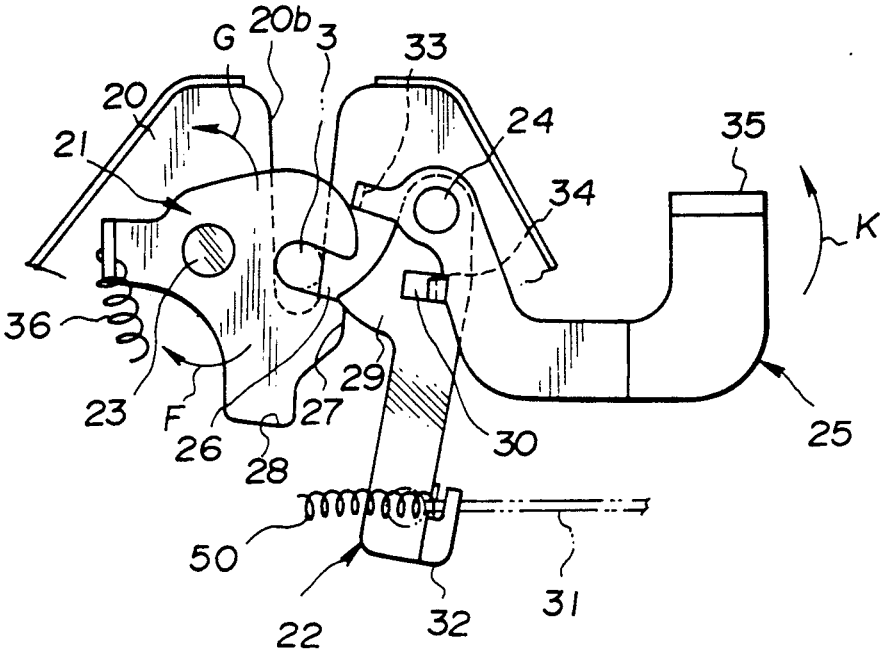
FIG. 3 is a rear view of the hood lock device in a full-latch condition.

As is seen from FIG. 3, a spring 50 is connected to the locking plate 22 to bias the same in a clockwise direction in the drawing. For the reason which will be described hereinafter, the locking plate 22 is permitted to pivot by a predetermined angle $\theta$ (see FIG. 4).

The full open lever 25 has at its upper side portion a first projection 33 which functions to suppress a pivotal movement of the second lever 25 under the full-latch condition of the lock device. The full open lever 25 has at its middle side portion a second projection 34 which is loosely received in the curved slot 30 of the locking plate 22 to obtain a so-called lost-motion connection between the full open lever 25 and the locking plate 22. The full open lever 25 has further a handle portion 35 which extends laterally from the major part of the full open lever 25.

In the following, operation of the hood lock device 37 will be described with reference to FIGS. 3 to 7.

Figure 7:
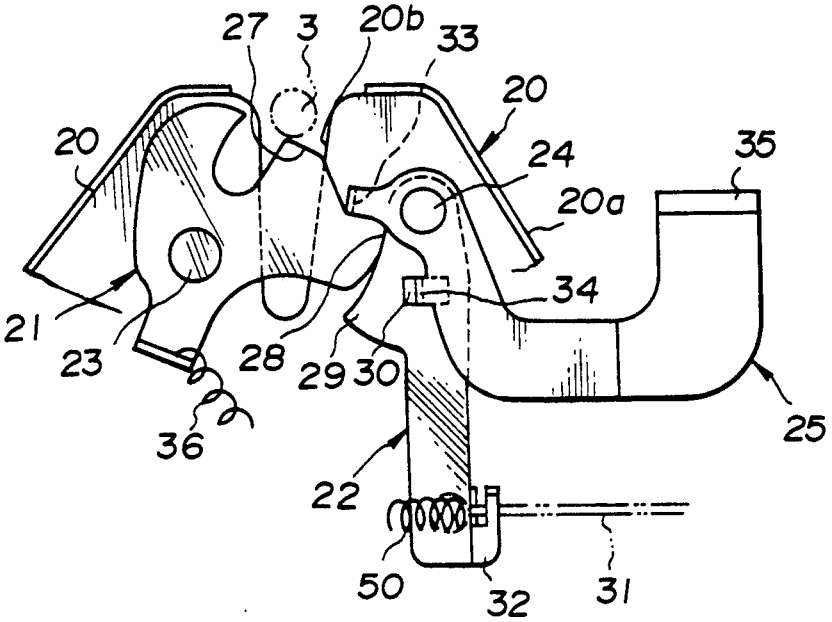
FIG. 7 is a view similar to FIG. 5, but showing a release condition of the hood lock device.

When the hood is kept opened, the latch plate 21 assumes a releasing position having its latching notch 26 directed upward due to biasing force of the spring 36. This condition is shown in FIG. 7. As shown in this drawing, the second engaging portion of the latch plate 21 is in engagement with the first projection 33 of the secondary latch 25.

When, for closing the hood, the same is pivoted down (see FIG. 3), the striker pin 3 enters the slot 20*b* of the base plate 20, slides down in the same and engages with the latching notch 26 of the latch plate 21 rotating the latch 21 in the direction of the arrow F against the biasing force of the spring 36. When, due to further downward movement of the striker pin 3, the latch plate 21 rotates and comes to a given angular position, the first projection 27 of the latch plate 21 rides over the pawl portion 29 of the locking plate 22 and comes into a latching engagement with the back of the pawl portion 29, as is shown in FIG. 3. Because the locking plate 22 is biased by the spring 50 in a clockwise direction, the engagement of the first projection 27 with the back of the pawl portion 29 suppresses a rotation of the latch plate 21 in the direction of the arrow G. Thus, the striker pin 3 is fully latched by the latch plate 21 inducing a fully latched closed position of the hood.

Under this full-latch condition of the lock device 37, the first projection 33 of the full open lever 25 is in abutment with an upper side surface of the latch plate 21. Thus, the full open lever 25 is suppressed from pivoting in the direction of the arrow K. This is very advantageous because the latched engagement between the first projection 27 of the latch plate 21 and the pawl portion 29 of the locking plate 22 is kept unchanged even when the full open lever 25 is unexpectedly pushed in the direction of the arrow K.

Figure 4:
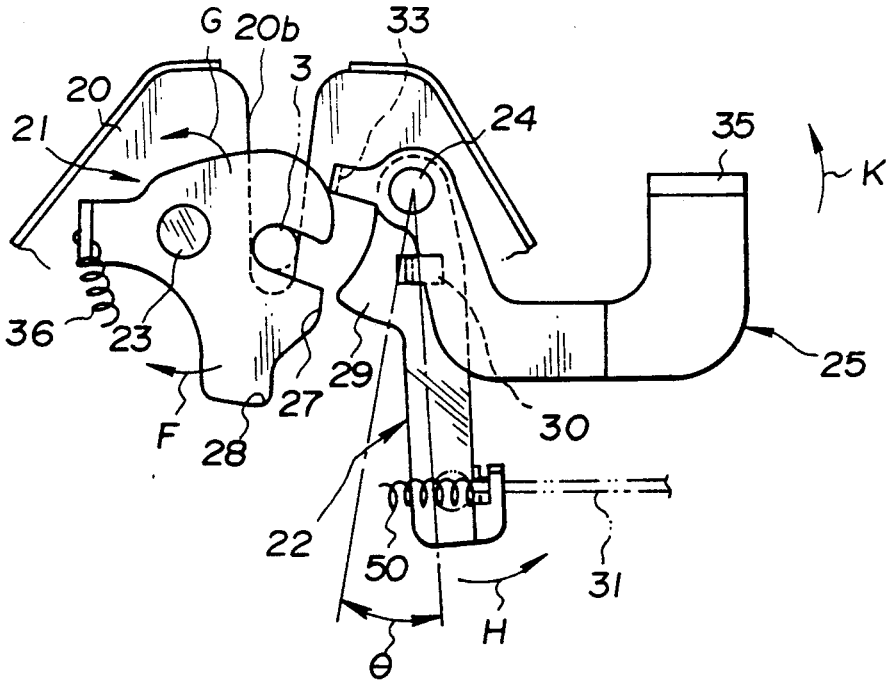
FIG. 4 is a view similar to FIG. 3, but showing a condition wherein a locking plate is being pivoted in the direction of the arrow H.

When, for opening the hood, the hood open lever is manipulated, the cable 31 is pulled against the force of the spring 50. With this, the locking plate 22 is pivoted in the direction of the arrow H by the given angle $\theta$ as shown in FIG. 4 cancelling the latched engagement between the first projection 27 and the pawl portion 29. Due to the biasing force produced by the hood lift mechanism and the biasing force of the spring 36, the latch plate 21 is thus rotated in the direction of the arrow G. When, as is seen from FIG. 5, the latch plate 21 thus rotated comes to a given angular position, the second engaging portion 28 of the latch plate 21 is brought into engagement with the pawl portion 29 of the locking plate 22 suppressing a further rotation of the latch plate 21. Thus, the striker pin 3 is halfly latched by the latch plate 21. Under this condition, the first projection 33 of the full open lever 25 is separated from the upper side surface of the latch plate 21. Furthermore, under this half-latch condition, there is defined between the front end of the hood and the front rigid portion of the engine room a certain clearance which is sized to permit insertion of an operator's hand.

Figure 5:
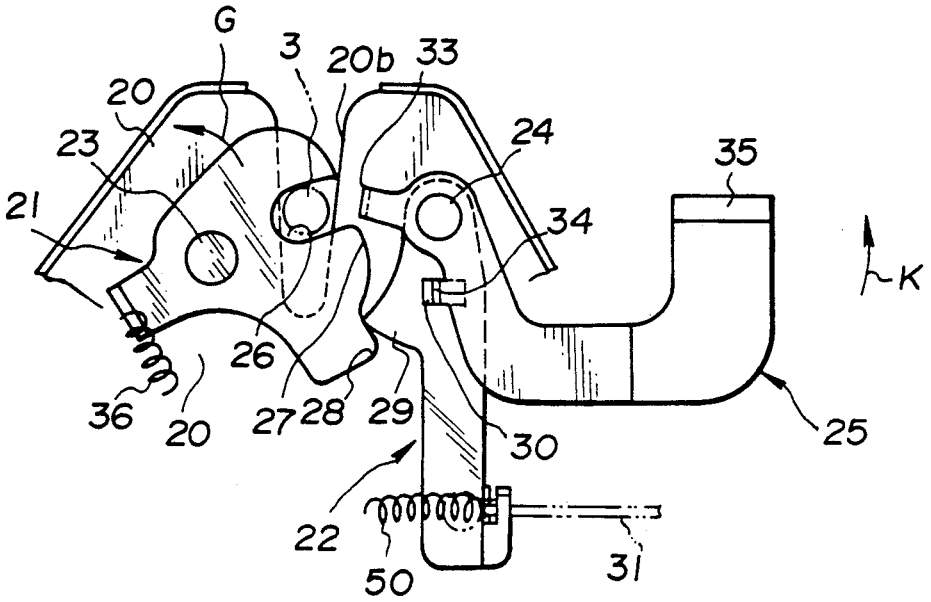
FIG. 5 is a view similar to FIG. 3, but showing a half-latch condition of the hood lock device.
Figure 6:
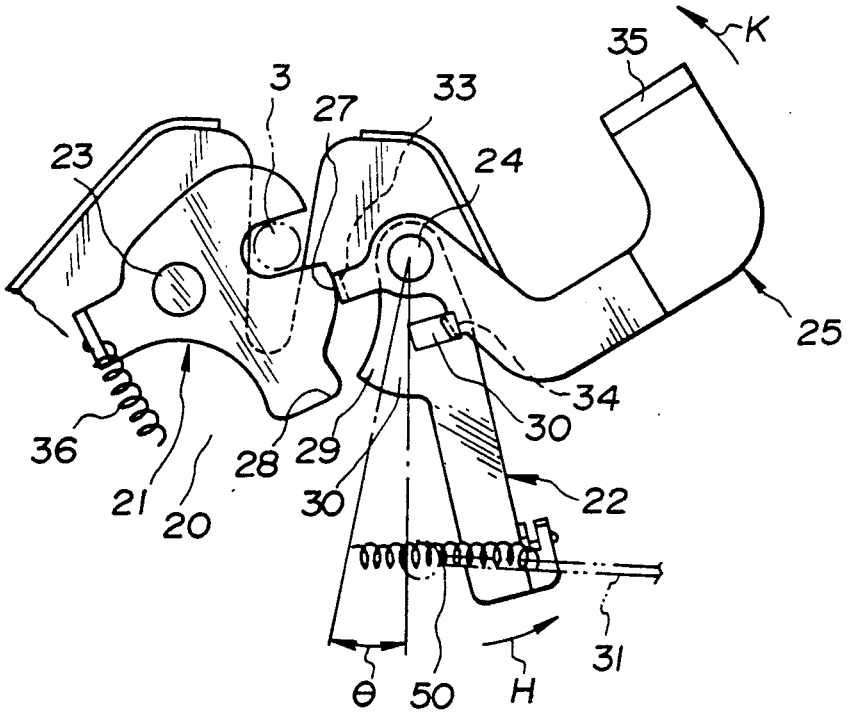
FIG. 6 is a view similar to FIG. 5, but showing a condition wherein the half-latch condition is being cancelled.

When, under this half-latch condition, the handle portion 35 of the full open lever 25 is manipulated to pivot the lever 25 in the direction of the arrow K in FIG. 5, the second projection 34 of the full open lever 25 comes to abut against a right end of the curved slot 30 of the locking plate 22 and thus further pivots the plate 22 in the direction of the arrow H beyond the angle $\theta$, as is seen from FIG. 6. With this, the pawl portion 29 of the locking plate 22 is separated from the second engaging portion 28 thereby releasing the latch plate 21. Thus, thereafter, the hood is permitted to open freely with the aid of the hood lift mechanism.

When the hood lock device 37 fully releases the hood, the same assumes the condition as shown in FIG. 7.

Figure 8:
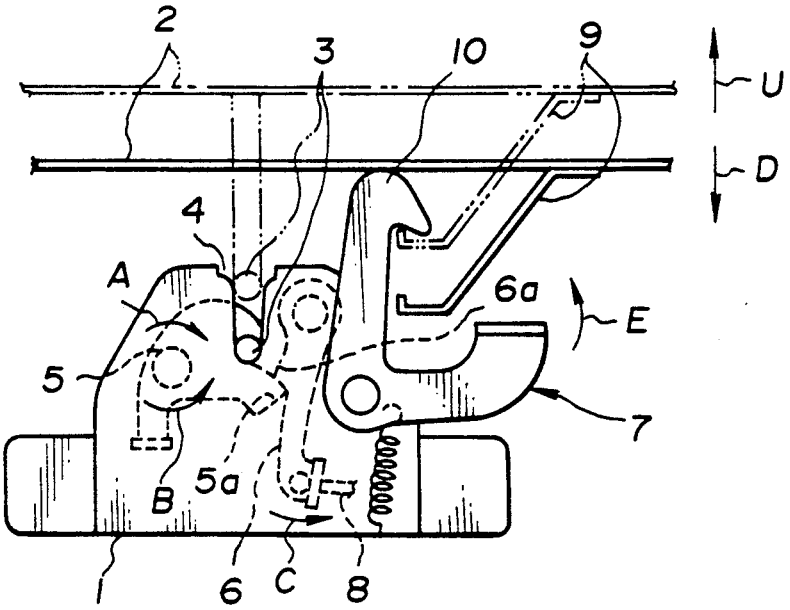
FIG. 8 (PRIOR ART)
FIG. 8 is a front view of a conventional hood lock device.

In the following, advantages of the present invention over the above-mentioned conventional device of FIG. 8 will be described.

First, irrespective of possessing both the full-latched and half-latched conditions, the hood lock device of the present invention has no means which corresponds to the pawl member 9 of the conventional device. Thus, the hood lock device 37 can be constructed compactly with lesser parts. The compact construction of the hood lock device is advantageous in designing the vehicle body. That is, the hood can assume a sufficiently low closed position.

Second, under the full-latch condition of the lock device 37, the first projection 33 of the full open lever 25 is in abutment with an upper side surface of the latch plate 21. Thus, an unexpected pivoting of the full open lever 25 in the latch cancelling direction is assuredly prevented. This is very advantageous in obtaining a safety operation of the hood lock device.

Third, because the pivoting of the locking plate 22 by the cable 31 is restricted to the given angle $\theta$, manipulation of the hood open lever does not induce undesirable sudden opening of the hood from the fully latched condition.

If desired, the following modification may be employed in the invention.

The so-called lost-motion connection between the locking plate 22 and the full open lever 25 is achieved by a projection provided on the locking plate 22 and an elongate slot formed in the full open lever 25. That is, in this case, the projection is loosely received in the elongate slot.

What is claimed is:

1. A lock device for locking a striker pin, comprising:

a base plate;

a latch plate pivotally connected to said base plate, said latch plate being formed with a latching notch, said latch plate having a full-latch position wherein said latching notch fully latches said striker pin, a half-latch position wherein said latching notch incompletely latches said striker pin and a release position wherein said latching notch fully releases said striker pin;

first biasing means for biasing said latch plate to pivot toward said release position;

a locking plate pivotally connected to said base plate, said locking plate having a pawl portion which is engageable with said latch plate to provide said latch plate with said full-latch and half-latch positions;

second biasing means for biasing said locking plate to pivot in a direction to achieve the engagement between the pawl portion and said latch plate;

a full open lever pivotally connected to said base plate, said full open lever being formed with a stopper projection which, when said latch plate assumes said full-latch position, abuts against a peripheral edge of said latch plate for suppressing pivoting of said latch plate toward said half-latch position; and a lost-motion mechanism arranged between said locking plate and said full open lever so that when, with said latch plate assuming said half-latch position, said full open lever is pivoted beyond a given degree, said pawl portion of said locking plate is disengaged from said latch plate thereby to permit said latch plate to assume said release position.

2. A lock device for locking a striker pin, comprising:

a base plate;

a latch plate pivotally connected to said base plate, said latch plate being formed with a latching notch, said latch plate having a full-latch position wherein said latching notch fully latches said striker pin, a half-latch position wherein said latching notch incompletely latches said striker pin and a release position wherein said latching notch fully releases said striker pin;

first biasing means for biasing said latch plate to pivot toward said release position;

a locking plate pivotally connected to said base plate, said locking plate having a pawl portion which is engageable with said latch plate to provide said latch plate with said full-latch and half-latch positions;

second biasing means for biasing said locking plate to pivot in a direction to achieve the engagement between the pawl portion and said latch plate;

a full open lever pivotally connected to said base plate; and a lost-motion mechanism arranged between said locking plate and said full open lever so that when, with said latch plate assuming said half-latch position, said full open lever is pivoted beyond a given degree, said pawl portion of said locking plate is disengaged from said latch plate thereby to permit said latch plate to assume said release position;

in which said locking plate and said full open lever are pivotally connected to said base plate through a common pivot pin.

3. A lock device as claimed in claim 2, in said lost-motion mechanism comprises:

a projection formed on one of said locking plate and said full open lever; and means defining an elongate slot formed in the other of said locking plate and said full open lever, said projection being loosely received in said elongate slot.

4. A lock device as claimed in claim 3, in which said elongate slot is curved to be concentric with a pivoted portion of the other of said locking plate and said full open lever.

5. A lock device as claimed in claim 4, in which said projection is formed on said full open lever and said elongate slot is formed in said locking plate.

6. A lock device as claimed in claim 5, in which said full open lever is formed with a stopper projection which, when said latch plate assumes said full-latch position, abuts against a peripheral edge of said latch plate for suppressing pivoting of said latch plate toward said half-latch position.

7. A lock device as claimed in claim 1, in which said latch plate has first and second engaging positions with which said pawl portion of said locking plate is latchingly engaged when said latch plate assumes said full-latch and half-latch positions respectively.

8. A lock device as claimed in claim 7, in which said first engaging portion is positioned near said latching notch, and in which the distance between said second engaging portion and a pivoted portion of said latch plate is greater than that between the first engaging portion and said pivoted portion.

9. A lock device as claimed in claim 4, in which said locking plate has a stopper means in order to prevent excess pivoting thereof when pivoted away from said latch plate.

10. A lock device for a motor vehicle having an engine room and a pivotal hood for the engine room, said lock device comprising:

a striker pin connected to said pivotal hood to move therewith;

a base plate secured to a rigid portion of said engine room, said base plate having a vertically extending slot which is sized to receive said striker pin;

a latch plate pivotally connected to said base plate, said latch plate being formed with a latching notch, said latch plate having a full-latch position wherein said latching notch fully latches said striker pin, a half-latch position wherein said latching notch incompletely latches said striker pin and a release position wherein said latching notch fully releases said striker pin;

first biasing means for biasing said latch plate to pivot toward said release position;

a locking plate pivotally connected to said base plate, said locking plate having a pawl portion which is engageable with said latch plate to provide said latch plate with said full-latch and half-latch positions;

second biasing means for biasing said locking plate to pivot in a direction to achieve the engagement between the pawl portion and said latch plate;

a full open lever pivotally connected to said base plate;

a lost-motion mechanism arranged between said locking plate and said full open lever so that when, with said latch plate assuming said half-latch position, said full open lever is pivoted beyond a given degree, said pawl portion of said locking plate is disengaged from said latch plate thereby to permit said latch plate to assume said release position; and a cable which is connected to said locking plate, so that when said cable is pulled in a given direction, said locking plate is pivoted away from said latch plate against the force of said second biasing means.

* * * * *